United States Patent [19]

Pierce

[11] 3,941,316

[45] Mar. 2, 1976

[54] APPARATUS FOR COMMINUTING AND EXTRACTING

[76] Inventor: Edgar M. Pierce, 4635 Drake Road, Cincinnati, Ohio 45243

[22] Filed: Mar. 18, 1975

[21] Appl. No.: 559,546

Related U.S. Application Data

[63] Continuation-in-part of Ser. No. 408,595, Oct. 23, 1973, abandoned.

[52] U.S. Cl. ..... 241/15; 241/21; 241/41; 241/79.1; 241/83

[51] Int. Cl.[2] ..... B02C 19/00

[58] Field of Search ..... 241/1, 15, 20, 21, 30, 241/38, 39, 41, 79.1, 83, 301; 198/193

[56] References Cited

UNITED STATES PATENTS

| | | | |
|---|---|---|---|
| 1,947,106 | 2/1934 | Plumstead | 241/41 x |
| 2,916,216 | 12/1959 | Altman et al. | 241/41 X |
| 2,917,245 | 12/1959 | Polleys | 241/15 X |
| 3,159,267 | 12/1964 | Jeffrey | 198/193 |
| 3,159,353 | 12/1964 | Atwater | 241/39 |
| 3,202,365 | 8/1965 | Barr, Jr. et al. | 241/41 X |
| 3,439,795 | 4/1969 | Roinestad | 198/193 |
| 3,680,796 | 8/1972 | Galeano | 241/79.1 |

*Primary Examiner*—Granville Y. Custer, Jr.
*Attorney, Agent, or Firm*—Wood, Herron & Evans

[57] ABSTRACT

Method and apparatus for comminuting cellulosic materials such as paper and destructible constituents of trash and garbage wherein the material is supported on a flat wire screen presenting sharp, upwardly directed edges and wherein the material is subjected to the force of jets under a high enough pressure to impact the material at at least 100 psi. The disclosure provides for varying the force of jets to accommodate differing qualities of material and to selectively comminute only that which is desired to be introduced into a slurry, the force being insufficient to comminute materials to be rejected.

13 Claims, 4 Drawing Figures

APPARATUS FOR COMMINUTING AND EXTRACTING

This application is a continuation-in-part of my copending application Ser. No. 408,595, filed Oct. 23, 1973, for APPARATUS FOR COMMINUTING AND EXTRACTING, now abandoned.

This invention relates to comminuting apparatus, and more particularly, the invention is directed to apparatus for comminuting cellulosic material by subjecting the cellulosic material to water under high pressure.

The apparatus principally used up to the time of the present invention for comminuting cellulosic material is a hydropulper, the hydropulper being most commonly used in the papermaking industry for the purpose of reducing paper to a slurry of cellulosic fibers. The hydropulper consists of a tank of substantial dimensions into which the comminutable material is introduced and submerged in an enormous quantity of water. The hydropulper has an impeller or agitator which, through its action, subjects the mixture to a violent enough agitation to break the comminutable material down into fibers of small enough size for further processing in other refining apparatus.

There are two disadvantages to the present practices of hydropulping which the present invention seeks to avoid. The first is the relatively high horsepower requirement of the hydropulper to comminute a relatively small mass of paper. The high horsepower is required because of the need to impart such great energy into the water within which the comminutable material is submerged.

Second, the hydropulper necessarily requires a substantial quantity of water per unit weight of material being comminuted, and this quantity of water creates a substantial disposal problem.

It has been an objective of the invention to provide a method and apparatus for comminuting material wherein the power requirement for comminuting a unit weight of material is one-third to one-fourth that required for a hydropulper to comminute the same weight of material.

It has been another object of the invention to provide a method and apparatus for comminuting material requiring substantially less water to effect the same comminution obtainable from a commercial hydropulper.

These objectives of the invention are attained by supporting the material to be comminuted on a foraminous surface presenting upwardly facing, sharp edges as, for example, a flat wire screen belt, and subjecting the material to the force of water under high pressure; that is, at least approximately 100 psi. The advantage of the invention, insofar as horsepower requirements are concerned, is that the energy is applied to the pulp process in a much more useful way than is possible in hydropulpers, for substantially all of its goes into the direct impacting of and reduction of the comminutable material to small particles or fibers. In contrast, in the hydropulper the greater portion of the energy goes into the movement of great masses of water with a small portion being actually useful in the reduction of the material to fibers.

Further, the invention admits of the use of much smaller quantities of water which are effectively employed in the substantially instantaneous comminution by impact.

The flat wire belt or a support structure comparable to it which presents rigid sharp edges is critically important to the invention. The small exposed area created by the undulating flat wire of the belt provides a rigid sharp surface against which the material is crunched by the impact of the impacting water jets. Further, the width of the individual flat wires is great enough to provide a long-wearing quality to the supporting surface. By contrast, a woven wire mesh is not suitable, for it entangles the fibers and other materials and, hence, mats and plugs easily. Additionally, it tends to give resiliently under the impacting force of the jets, thereby absorbing some of the energy of the jets in the flexing of the screen rather than pulverizing the material.

There are two areas of relevant prior practices, aside from the hydropulper, which fail to do as effective a job of comminution as the present invention. First, it is known to support newsprint, for example, on an endless screen conveyor belt and subject it to sprays of water to effect some degree of comminution. That apparatus and process contemplate a gentle spray wherein enormous quantities of water would be required to effect the same degree of comminution as the present invention, and it fails to utilize the two critical factors of supporting material on a flat wire belt and impacting at high pressure.

A second approach, likewise not believed to have enjoyed any commercial use, involves the introduction of material into a tank of water and subjecting the submerged material to the action of high velocity jets. This approach, too, lacks the critical factors of the present invention, for the energy of the high velocity jets is dissipated quickly upon striking the water as contrasted to the process and apparatus of the invention wherein the high velocity jets impact the material directly, the material being rigidly backed up by the flat wire belt. Thus, the impacting force of the water in the present invention has maximum comminuting effect.

Another objective of the invention has been to provide a method of extracting desired constituents from a mass of material at least a portion of which is comminutable. For example, within the greater purview of the invention, it is contemplated that municipal solid wastes such as garbage, trash and the like can be processed on the apparatus of the present invention with the force of the jets being regulated to selectively comminute that which is desired for reuse while rejecting, by applying insufficient force to the jets, undesirable constituents. The slurry of pulverized matter may be subjected to a water extraction process as, for example, that disclosed in my U.S. Pat. No. 3,863,559 and thereafter used as a fuel. Where it is contemplated that the useful product will be a fuel, the force of the jets may be high enough to comminute combustible plastics but insufficiently high to comminute glass and metals which would be rejected as solids. On the other hand, if plastic material is regarded as an undesirable constituent in the useful product, the jet would be maintained at about 100 psi at impact, which is insufficiently great to comminute plastic but sufficiently great to comminute the cellulosic material.

It has been another objective of the invention to provide apparatus for comminuting material including a longitudinally movable flat wire belt supporting the material, a line of jet nozzles overlying the belt and means for reciprocating the nozzles to provide complete coverage of material on the belt with impacted water from the nozzles.

The reciprocation of the nozzles, while not as critically important as their velocity at impact and the quality of the supporting surface, nevertheless does appear to enhance the comminuting capability of the system in creating pulsations over the surface of the belt. Additionally, the reciprocation of the jets admits of the possibility of using fewer jets with consequent greater water efficiency than would be possible with a grouping of stationary jets.

The several objectives and features of the invention will become more readily apparent from the following detailed description taken in conjunction with the accompanying drawings in which.

Figure 1:
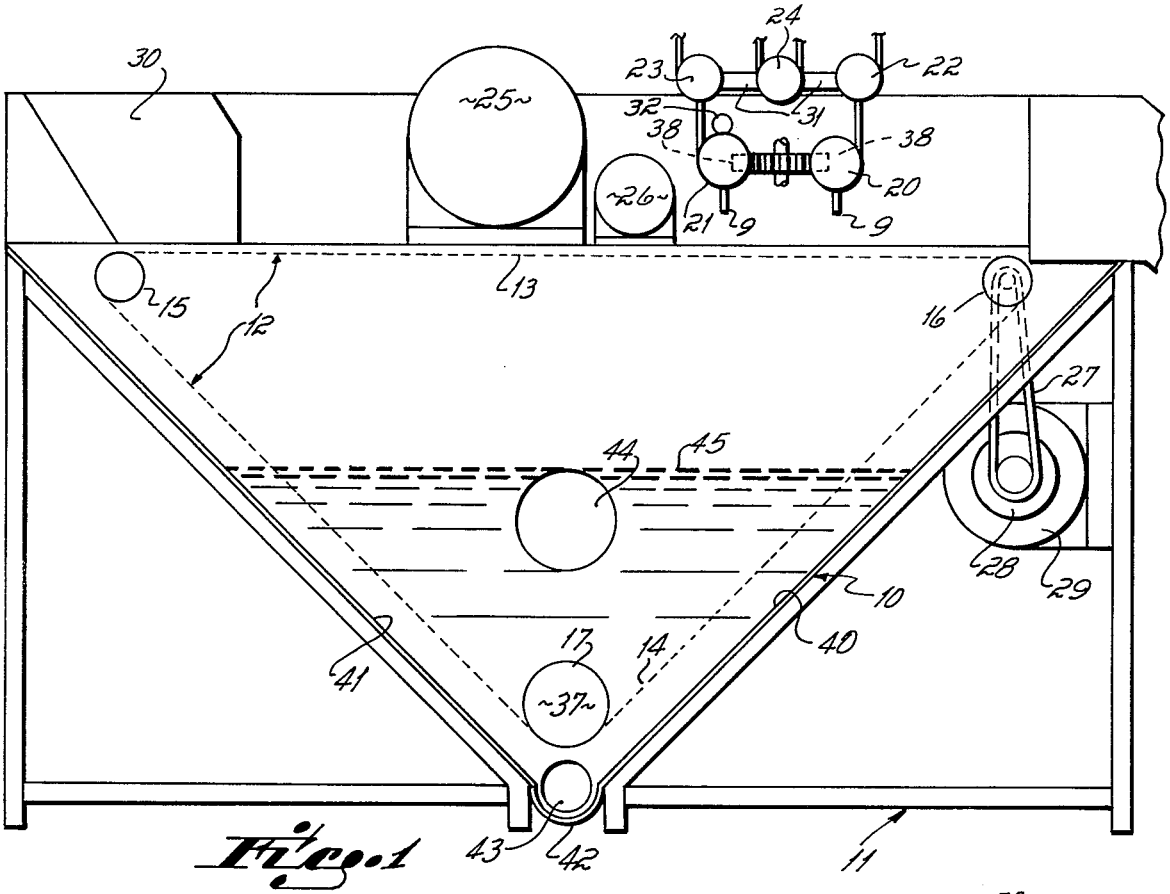
FIG. 1 is a diagrammatic side elevational view of apparatus in accordance with the present invention.
Figure 3:
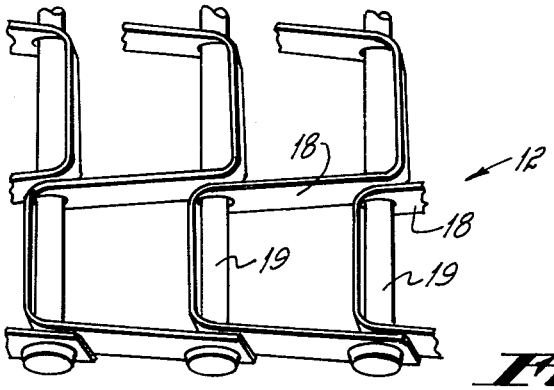
FIG. 3 is a fragmentary perspective view of the supporting flat wire belt.
Figure 4:
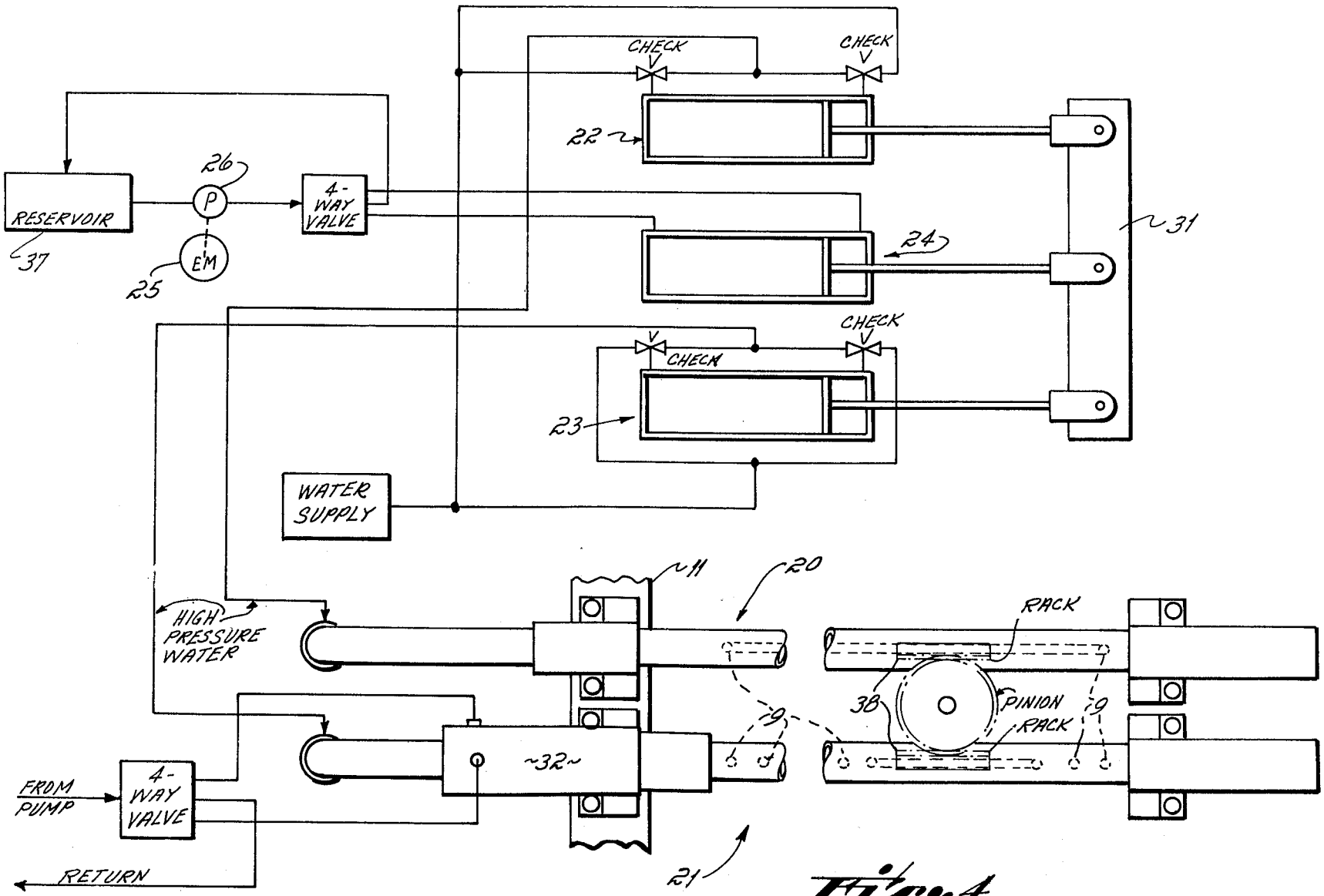
FIG. 4 is a diagrammatic view of the system for delivering water under pressure to reciprocating nozzles.

One form of apparatus embodying the invention is illustrated in FIG. 1. There, a tank 10 is supported on a base 11, the tank being adapted to receive the slurry formed by the comminuted material and water. An endless flat wire belt 12 has an upper flight 13 and a V-shaped lower flight 14 formed by the belt passing over two upper drums 15 and 16 and a lower drum 17 in the bottom of the tank. The flat wire belt is preferably the type formed by undulating flat wire 18 secured together by transverse pins 19 as illustrated in FIG. 3. The mesh is one inch by one inch, the flat wire having approximately 1/2 × 1/16 inch dimension. These dimensions may be varied within practical limits without departing from the invention. Referring to FIGS. 1 and 4, overlying the upper flight 13 of the belt are two lines of nozzles 9 mounted in tubes or headers 20 and 21. The nozzles are supplied with water under high pressure from piston pumps 22 and 23, respectively, the pumps being driven by a hydraulic piston motor 24, the motor piston having a direct driving connection to the water pump pistons through a cross bar 31 to which all pistons are connected. An electric motor 25 drives an oil pump 26 which supplies oil under pressure to the piston motors 24.

The drum 16 is connected through a chain 27 and a gear box 28 to a drive motor 29, causing the upper flight 13 of the belt to move toward the right as viewed in FIG. 1.

An inlet 30 for the system is provided at the upstream end of the belt, into which material to be comminuted is introduced. A discharge chute is provided at the downstream end of the belt through which rejects, that is, difficult to comminute or non-comminutable material, are discharged.

In the operation of the invention thus far described, the material to be comminuted is introduced onto the upper flight 13 of the belt and is conveyed downstream until it passes under the jet nozzles 9 on headers 20, 21. The force of the water from the nozzles 9 impacting on the material causes it to be broken up and pass through the holes in the belt and into the tank 10. In the tank 10, the material forms a slurry with the water used in the comminution process and the slurry is continuously withdrawn from the tank.

The precise location, orientation and manipulation of the headers 20, 21 is not important as long as the combination of factors is such as to produce complete jet coverage of the material passing under the jets with an impact force of at least approximately 100 psi on the surface of the material. In the form of the invention illustrated in FIG. 4, two headers 20 and 21 are employed. Each nozzle has a 1/16 inch diameter orifice and is spaced twelve inches above the conveyor. The respective headers are reciprocated 180° out of phase by a small oil reciprocator 32. The reciprocator is fixed to the base 11 and is connected to header 21 to reciprocate it. Racks 38 are mounted on each header and are interconnected by a pinion 39 so that reciprocation of header 21 causes reciprocation of header 20 in the opposite direction. The reciprocation of the headers 180° out of phase balances the headers and reduces vibration. The nozzles are spaced on 6 inch centers, one line of nozzles being offset from the other by 3 inches. The reciprocation stroke for each line of nozzles is three inches to provide complete coverage of the material.

Alternatively, one line of jets mounted only on header 21 on three inch centers could be employed rather than the illustrated two lines 20 and 21. The line of jets would be reciprocated at approximately ten cycles per minute on a 3 inch stroke, with each jet being supplied with approximately one gallon of water per minute.

The speed of movement of the conveyor underneath is related to the speed of reciprocation of the jets so as to provide complete coverage of the material passing underneath. The speed of the belt selected for ten cycles would be doubled if the frequency of reciprocation were increased to twenty cycles per minute.

The selection of the nozzle for each jet is important and must be of impacting nozzle design. The impacting nozzle creates a relatively thin stream of water between the nozzle orifice and the surface of the belt. For example, a nozzle having a 1/16 inch diameter orifice spaced approximately twelve inches above the belt would create an impact area on the belt of approximately one square inch. With such a nozzle, to attain the desired 100 lbs. per square inch of force at the belt, the nozzle should be supplied with water at approximately 1000 psi. A pressure substantially below 1000 psi as, for example, 700 psi, will not have a satisfactory impact force and hence will not comminute material such as paper to a satisfactory extent.

The tank as illustrated is V-shaped, having downwardly inclined side walls 40 and 41 terminating in an apex 42. At the apex is an outlet 43 for the discharge of undesirable heavy solids such as grit. Spaced above the grit outlet 43 is a slurry outlet 44 through which the slurry is continuously withdrawn, the level of the slurry being indicated at 45. An oil reservoir 37 is located in the bottom of the tank. The oil spent from the motor 24 is fed to the oil reservoir 37 disposed in the bottom of the tank where the oil is cooled by the slurry continuously being created in passing out of the tank.

In the operation of the embodiment of FIG. 1, dry material is introduced to the upper flight 13 of belt 12 through the inlet 30 and passes along the belt to the jets emanating from the nozzle headers 20, 21. The headers 20, 21 are reciprocating 180° out of phase so as to provide complete coverage of the material to be comminuted. As the material passes under any one nozzle, the impact force of the water smashing the comminutable material against the flat wire belt breaks the material down into fibers or small clusters of fibers which pass immediately through the holes in the belt into the tank 10. Large lumps or other undesirable material not comminuted by the jets pass over the downstream end of the belt and out the discharge chute.

The combination of water and pulp continuously forms a slurry in the tank, that slurry being continuously discharged through the outlet 44.

Recognizing that different qualities of material require different forces to comminute them, it is preferred to have variable controls on the motor 29 which drives the belt 12 and the motor 25 and pump 26 which creates the pressure in the water emanating from the nozzles 90. With these controls, it is possible to vary the impact force of the water on the material being processed and to vary the length of time that the material is subjected to the destructive force of the water.

Figure 2:
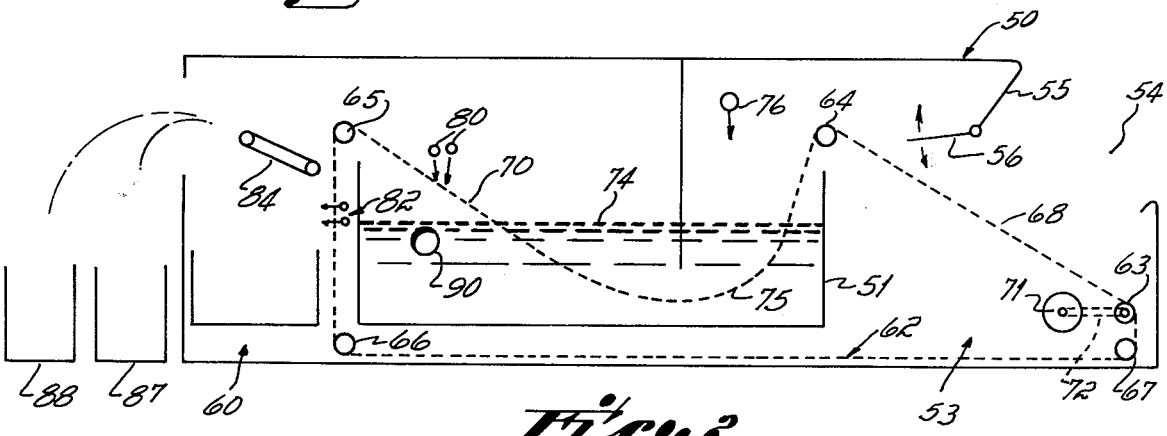
FIG. 2 is a diagrammatic side elevational view of modified apparatus.

The embodiment of FIG. 2 is particularly suitable for extracting in a slurry form the comminutable material from trash and garbage. The apparatus includes a housing 50 within which a tank 51 is contained centrally of the housing. At the upstream end of the housing is a loading chamber 53 having an inlet opening 54 through which trash may be dumped from a vehicle in which it is collected. The chamber 53 has an inclined wall 55 terminating in a swinging plate 56 which engages the material introduced into the apparatus and imparts a first leveling force to it. At the downstream end of the apparatus is a reject chamber 60 wherein rejected materials are segregated, collected and hauled away. A flat wire belt 62 of the type described above passes over drums 63, 64, 65, 66 and 67 to provide an upper flight having an upstream section 68 passing through the trash inlet chamber 53 and a downstream section 70 passing through the tank 51 and upwardly out of the tank at an angle no greater than 30°. The belt is driven by a motor 71 connected through a chain 72 to the drum 63.

The water in the tank is maintained at a level indicated at 74. The downstream section 70 of the belt 62 has a first portion 75 which passes well below the water level so as to give the trash a good soaking before being subjected to the action of the jets of the present invention. The apparatus may include low pressure water jets 76 to provide sufficient water to drench the incoming material. The drenching of the material serves two functions—first, to cause the material to lose some of its strength, and second, to compact the cellulosic material against the belt so that it will be more susceptible to destruction by impact of the downstream jets.

Overlying the downstream section of the belt which extends above the water level are two rows of transverse jets 80 constructed in the manner described in connection with the embodiment of FIG. 1 and supplied with water under high pressure of approximately 1000 psi as described in connection with the embodiment of FIG. 1. These high pressure jets comminute all of the garbage and cellulosic material in the trash, driving it through the holes in the belt into the water below wherein it forms a pump slurry. If plastics are to be comminuted, the water pressure should be raised to at least 1200 psi.

The material which is not destructed passes over the downstream end of the belt and into the reject chamber 60. Plastic films such as polyethylene will cling to the belt and may be blown off the belt by air jets at 82 into a reject container. Cans, bottles, plastic containers and the like will drop onto a high speed conveyor belt 84 and be flung from the discharge end of that conveyor. The action of flinging the articles off the discharge end of the conveyor will effect a separation of them into different categories in accordance with what their weight may be, the heavier materials being thrown farther than the lightweight materials, thus separating them into two containers 87, 88.

The pulp slurry is removed from the tank through an outlet 90 and pumped through strainers to a stock vat. From that point, the slurry is subjected to further treatment, depending upon the use to which the fibers are to be put. One such further treatment would be to introduce the slurry into a dewatering press of the type described in my U.S. Pat. No. 3,863,559 wherein substantially all of the water is squeezed out of the material, thus providing flat cakes of material. This material may be burned as fuel or may be further processed to form fiberboard or the like.

While the invention has been described in connection with the extraction of pulp from incoming paper or trash, it should be understood that it can be employed in other extraction processes, and particularly those wherein more easily comminuted materials are separated from other materials; for example, the pith is separated from the fibers of water hyacinths. In a sugar extraction process, bagasse is depithed. Disposable diapers are treated to separate the cellulosic fibers from the plastic films.

Having described my invention, what I claim is:

1. Apparatus for comminuting cellulosic materials comprising:

a foraminous bar type conveyor providing substantially rigid sharp edges for supporting said materials, at least one jet impact nozzle overlying said conveyor, means for supplying water under high pressure to said nozzle to impact said conveyor with a force of at least approximately 100 psi, means for moving said conveyor past said nozzle, and means for reciprocating said nozzle in a direction transverse to movement of said conveyor.

2. Apparatus according to claim 1 further comprising:

a plurality of laterally spaced nozzles, the length of the reciprocating stroke combined with the motion of the conveyor and impact area of the water on the conveyor providing complete coverage of the operating area of said conveyor with high impact water.

3. Apparatus according to claim 1 in which said nozzle has approximately the following dimensional relationships with respect to said conveyor:

1/16 inch diameter nozzle orifice, one square inch impact area on said conveyor, the distance between said nozzle and said conveyor being twelve inches.

4. Apparatus according to claim 3 in which said water supplying means supplies water to said nozzle at a pressure of at least approximately 1000 psi.

5. Apparatus according to claim 1 further comprising:

a first line of laterally spaced nozzles, a second line of said laterally spaced nozzles, said first and second lines of nozzles being longitudinally spaced from each other, and means for transversely reciprocating said nozzles 180° out of phase.

6. Apparatus according to claim 1 in which said bar type conveyor has approximately a one inch by one inch mesh.

7. Apparatus according to claim 1 further comprising:

a tank disposed below said conveyor, said tank having a V-shaped bottom, a grit outlet in the apex of said V-shaped bottom and a slurry outlet spaced above said grit outlet.

8. Apparatus according to claim 7 further comprising:

means for discharging rejected material from the downstream end of the upper flight of said conveyor.

9. Apparatus according to claim 1 further comprising:

a drenching station located in the path of said conveyor and spaced upstream from said nozzle, said drenching station including means for thoroughly soaking with water the material on said conveyor.

10. Apparatus according to claim 9 in which said drenching station includes jets spaced above said conveyor for spraying material on said conveyor with water and a tank adapted to contain water at a level substantially above said conveyor.

11. Apparatus according to claim 1 further comprising:

means for varying the impact force of said water.

12. The method of comminuting cellulosic material comprising the steps of:

rigidly supporting said material on a backing of sharp edges, impacting said materail with water at a force of at least approximately 100 psi, and reciprocating a jet of water directed onto said material in a first direction to perform said impacting step and conveying said material past said reciprocating jet in a direction perpendicular to the direction of reciprocation.

13. The method of converting trash, garbage and the like into a useful product comprising the steps of:

supporting the material to be converted on a mesh belt having upwardly facing sharp edges, impacting said material with jets of water, the force of impact on said material being at least approximately 100 psi, the impacting force being sufficiently high to comminute the material to be converted to a useful form and insufficiently high to comminute the harder to destruct, less desirable materials, and reciprocating the jets of water in a transverse direction while conveying the material underneath the jets in a longitudinal direction.

* * * * *